US011060810B2

(12) United States Patent
Chen

(10) Patent No.: US 11,060,810 B2
(45) Date of Patent: Jul. 13, 2021

(54) AUXILIARY BULLET LOADER FOR MAGAZINE

(71) Applicant: Shenzhen Ludesi Technology Co., Ltd., Shenzhen (CN)

(72) Inventor: Xiaoxun Chen, Guangdong (CN)

( * ) Notice: Subject to any disclaimer, the term of this patent is extended or adjusted under 35 U.S.C. 154(b) by 0 days.

(21) Appl. No.: 17/153,907

(22) Filed: Jan. 21, 2021

(65) Prior Publication Data

US 2021/0164746 A1 Jun. 3, 2021

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
See application file for complete search history.

(56) References Cited

U.S. PATENT DOCUMENTS 4,570,371 A * 2/1986 Mears ..... F41A 9/83 42/87
4,719,715 A * 1/1988 Howard ..... F41A 9/83 42/87
5,249,386 A * 10/1993 Switzer ..... F41A 9/83 42/87
6,286,243 B1 * 9/2001 Hinton ..... F41A 9/83 42/87
6,810,616 B2 * 11/2004 Tal ..... F41A 9/83 42/87
10,598,456 B1 * 3/2020 Tal ..... F41A 9/83
2008/0184608 A1 * 8/2008 Tal ..... F41A 9/83 42/87
2018/0066907 A1 * 3/2018 Hefer ..... F41A 9/83
2020/0173746 A1 * 6/2020 Hefer ..... F41A 9/83

FOREIGN PATENT DOCUMENTS

GB 555367 A * 8/1943 ..... F41A 9/83

* cited by examiner

*Primary Examiner* — Gabriel J. Klein
(74) *Attorney, Agent, or Firm* — Prakash Nama; Global IP Services, PLLC

(57) ABSTRACT

The present invention provides an auxiliary bullet loader for a magazine, which includes a housing, wherein the housing is provided with a mounting space for accommodating a magazine, a first swinging mechanism is connected to a top portion of the housing, the first swinging mechanism includes a first pressing plate, the first pressing plate includes a first engaging end, the first engaging end extends obliquely downwards into the mounting space, and a bullet inlet of the magazine when the magazine is loaded into the mounting space faces upwards, the first engaging end is inserted into the magazine and swings relative to the housing under an action of the magazine, thereby pressing a follower within the magazine.

17 Claims, 6 Drawing Sheets

AUXILIARY BULLET LOADER FOR MAGAZINE

BACKGROUND OF THE INVENTION

The present invention relates to the technical field of weapon accessories, and particularly to an auxiliary bullet loader for a magazine.

A magazine is an instrument for loading bullets, which is generally of a shape of a flat bar, and is provided with a bullet chamber for accommodating the bullets inside. An inlet for loading the bullets into the bullet chamber is provided in a top portion of the bullet chamber. A movable follower is provided in the bullet chamber. A magazine spring driving the follower to reset and move upwards is connected to a bottom of the follower. The follower supports the bullet at the uppermost end in the bullet chamber to the bullet loading hole under an action of the magazine spring and aligns the bullet to a preparatory feeding position.

In the prior art, when there is a need for loading the bullet in the magazine chamber of the magazine, the magazine is generally held in one hand and the bullet is held in the other hand to press the follower to compress the magazine spring to move downwards, and further the bullet is pressed into the magazine via an inlet of the magazine chamber. Since the bullet is loaded into the bullet chamber by pressing the follower to move downwards with the bullet, this makes an operation of loading the bullet to the magazine more troublesome and inefficient.

BRIEF SUMMARY OF THE INVENTION

In view of this, there is provided an auxiliary bullet loader for a magazine, to make a bullet loading operation of the magazine simple and quick.

The present invention provides an auxiliary bullet loader for a magazine, which includes a housing, wherein the housing is provided with a mounting space for accommodating a magazine, a first swinging mechanism is connected to a top portion of the housing, the first swinging mechanism includes a first pressing plate, the first pressing plate includes a first engaging end, the first engaging end extends obliquely downwards into the mounting space, and a bullet inlet of the magazine when the magazine is loaded into the mounting space faces upwards, the first engaging end is inserted into the magazine and swings relative to the housing under an action of the magazine, thereby pressing the follower within the magazine.

Further, the first pressing plate is an elastic pressing plate, and the first engaging end deforms under an action of the magazine to swing relative to the housing.

Further, the first swinging mechanism further includes a first elastic member and a first pivot, wherein the first pressing plate is pivotally connected onto the housing through the first pivot, and the first elastic member is sleeved on the first pivot, the first engaging end swings around the first pivot under an action of the magazine to deform the first elastic member.

Further, a guiding groove is provided in an outer wall surface, which is away from the mounting space, of the first engaging end.

Further, the inner wall surface, which faces the mounting space, of the first engaging end is an arc-shaped surface.

Further, the auxiliary bullet loader for the magazine further includes a second swinging mechanism connected to a bottom portion of the housing, wherein the second swinging mechanism includes a second pressing plate, the second pressing plate includes a second engaging end, the second engaging end extends obliquely upwards into the mounting space, and the second engaging end swings relative to the housing under an action of the magazine when the magazine is mounted into the mounting space.

Further, the second pressing plate is an elastic pressing plate, and the second engaging end deforms under an action of the magazine to swing relative to the housing.

Further, the second swinging mechanism further includes a second elastic member and a second pivot, wherein the second pressing plate is connected onto the housing through the second pivot, the second elastic member is sleeved on the second pivot, and the second engaging end swings around the second pivot under an action of the magazine and deforms the second elastic member.

Further, the auxiliary bullet loader for the magazine further includes a third swinging mechanism connected to a top portion of the housing, and the third swinging mechanism and the first swinging mechanism are respectively positioned on a front side and a rear side of the top portion of the housing.

Further, the third swinging mechanism includes a third pressing plate, wherein the third pressing plate includes a third engaging end, the third engaging end extends into the mounting space, the third engaging end inclines downwards and backwards, and the first engaging end inclines downwards and forwards.

Further, the third pressing plate is an elastic pressing plate, and the third engaging end deforms under an action of the magazine to swing relative to the housing.

Further, the third swinging mechanism further includes a third elastic member and a third pivot, wherein the third pressing plate is connected onto the housing through the third pivot, the third elastic member is sleeved on the third pivot, and the third engaging end swings around the third pivot under an action of the magazine and deforms the third elastic member.

Further, the housing includes a back plate and side plates respectively connected to a left side and a right side of the back plate, the mounting space is formed between the side plates, and the first swinging mechanism is connected to a top portion of the back plate.

Further, one of the side plates and the back plates is provided with a shaft hole and the other one is provided with a shaft, and the shaft is inserted into the shaft hole to connect the side plates with the back plate rotatably.

Further, a tail end of the shaft is of an external gear structure, the shaft hole is of an internal gear structure, and the tail end of the shaft is inserted into the shaft hole and meshed with the shaft hole.

The present invention further provides an auxiliary bullet loader for a magazine, which includes a housing, wherein the housing includes a back plate and side plates connected to two opposite sides of the back plate, and a mounting space is formed between the side plates for accommodating a magazine, a first swinging mechanism is connected to a top portion of the back plate; the first swinging mechanism includes a first pressing plate, wherein the first pressing plate includes a first connecting end and a first engaging end which are opposite, the first connecting end is connected with the housing, the first engaging end extends obliquely downwards into the mounting space, the magazine is mounted within the mounting space between the two side plates towards the back plate, the first engaging end is inserted into the magazine and swings towards the back plate under an action of the magazine to press the follower within the magazine.

Further, the first swinging mechanism further includes a first elastic member and a first pivot, wherein the first connecting end is connected onto the housing through the first pivot, the first elastic member is sleeved on the first pivot, and the first engaging end swings around the first pivot under an action of the magazine and deforms the first elastic member.

Further, the auxiliary bullet loader for the magazine further includes a second swinging mechanism connected to a bottom portion of the back plate, wherein the second swinging mechanism includes a second pressing plate, a second elastic member and a second pivot, and the second pressing plate includes a second connecting end and a second engaging end which are opposite, the second connecting end is connected onto the back plate through the second pivot, the second elastic member is sleeved on the second pivot, the second engaging end extends obliquely upwards into the mounting space, and when the magazine is mounted into the mounting space, the second engaging end swings towards the back plate around the second pivot under an action of the magazine and deforms the second elastic member.

Further, an arm portion protrudes forwards from a top portion of the back plate, a third swinging mechanism is connected onto the arm portion, the third swinging mechanism includes a third pressing plate, a third elastic member and a third pivot, the third pressing plate includes a third connecting end and a third engaging end which are opposite, the third connecting end is connected onto the arm portion through the third pivot, the third elastic member is sleeved on the third pivot, the third engaging end extends obliquely downwards into the mounting space, and when the magazine is mounted into the mounting space, the third engaging end swings upwards around the third pivot under an action of the magazine and deforms the third elastic member.

Further, one of the side plates and the back plate is provided with a shaft hole and the other one is provided with a shaft, a tail end of the shaft rod is of an external gear structure, the shaft hole is of an internal gear structure, and the tail end of the shaft is inserted into the shaft hole and meshed with the shaft hole.

Compared with the prior art, the auxiliary bullet loader for the magazine of the present invention has the advantages that a swinging apparatus is connected onto its housing, the magazine is mounted into the mounting space of the housing to make the pressing plate of the swinging apparatus swing, and the tail end of the engaging end moves downwards and presses the follower, so that holding the magazine and pressing the follower in the magazine may be achieved by one hand, as such, the user may rapidly load the bullet without pressing the follower by the bullet when loading the bullet with the other hand.

DETAILED DESCRIPTION OF THE INVENTION

In order to make the objective, the technical solution and advantages of the present invention clearer, the following further describes the present invention in detail with reference to accompanying drawings and embodiments. It should be understood that specific embodiments described herein are only used to explain the present invention, but not to limit the present invention.

The same or similar reference numbers in the accompanying drawings of this embodiment correspond to the same or similar components. In the description of the present invention, it should be understood that if an orientational or positional relationship indicated by terms "upper", "lower", "left", "right" and the like is based on an orientational or positional relationship shown in the accompanying drawings, and is only for the convenience of describing the present invention and simplifying the description, rather than indicating or implying that the indicated apparatus or element must have a specific orientation or must be constructed and operated at a specific orientation, therefore, the terms describing the positional relationship in the accompanying drawings are only for exemplary description, and cannot be understood as a limitation of the patent. For those ordinarily skilled in the art, specific meanings of the above terms may be understood according to specific circumstances.

Figure 1:
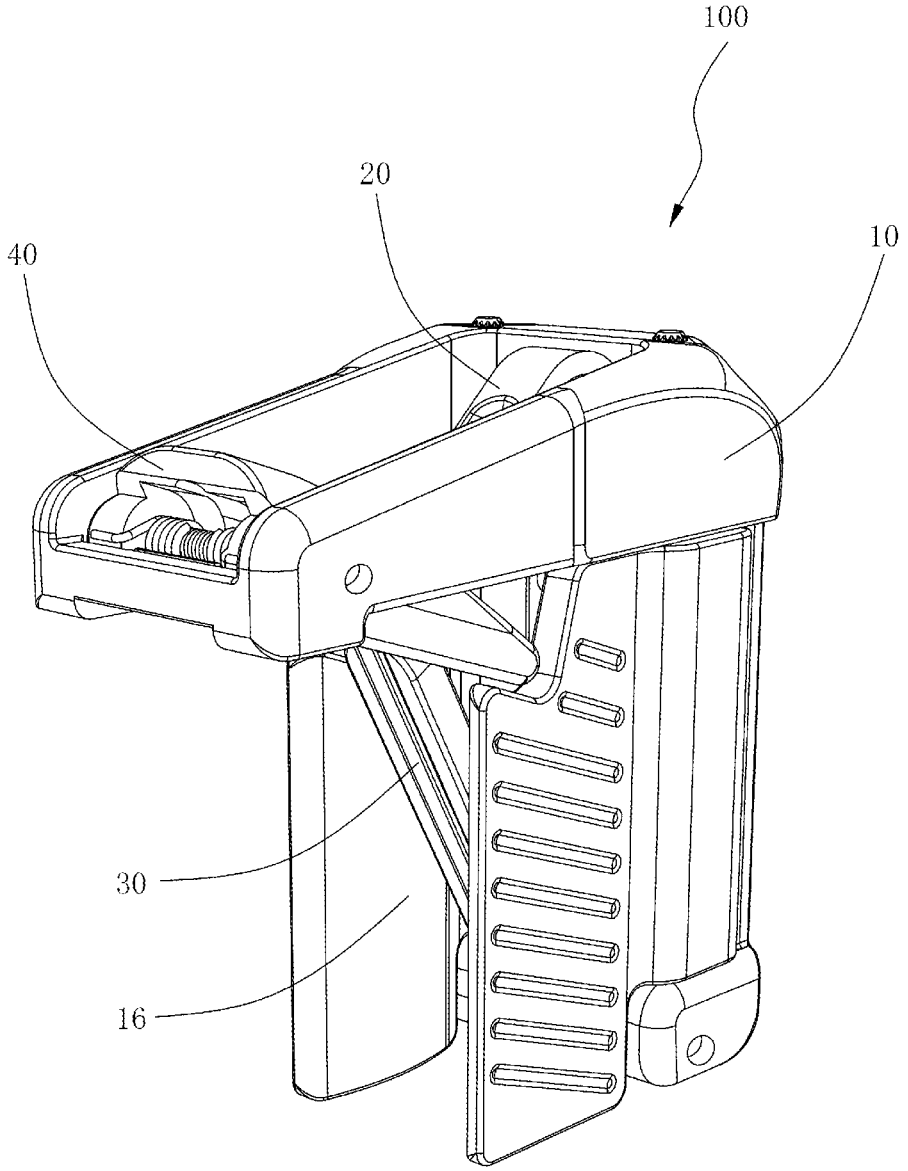
FIG. 1 is a schematic diagram showing a structure of an auxiliary bullet loader for a magazine according to an embodiment of the present invention.
Figure 2:
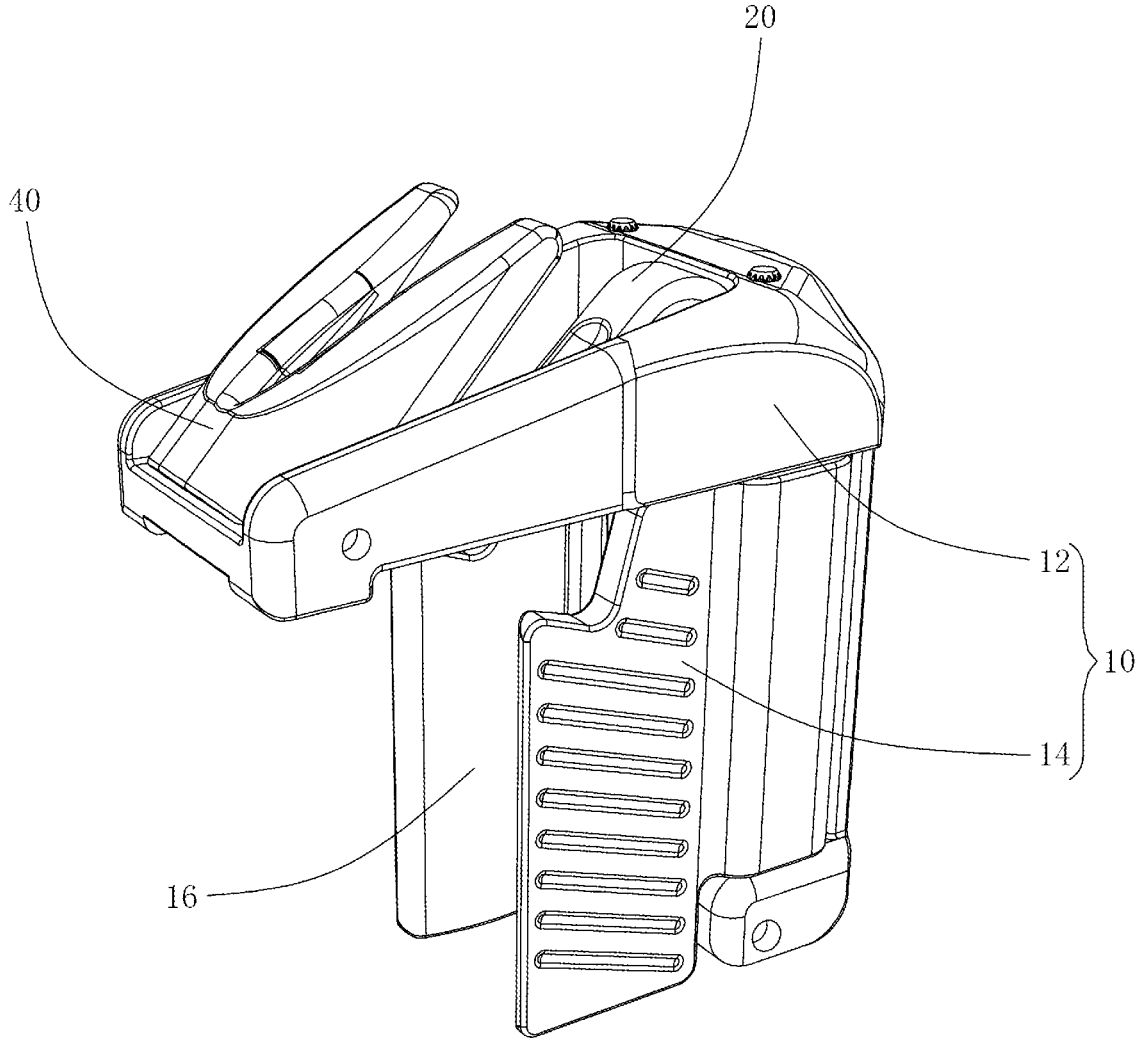
FIG. 2 is a schematic diagram showing a state of an auxiliary bullet loader for a magazine as shown in FIG. 1 in a bullet loading process.

The auxiliary bullet loader for the magazine of the present invention is used to assist a bullet loading operation of the magazine. As shown in FIG. 1 and FIG. 2, the auxiliary bullet loader 100 for the magazine according to a specific embodiment of the present invention includes a housing 10 and a first swinging mechanism 20, wherein the first swinging mechanism 20 is connected to a top end of the housing 10.

Figure 3:
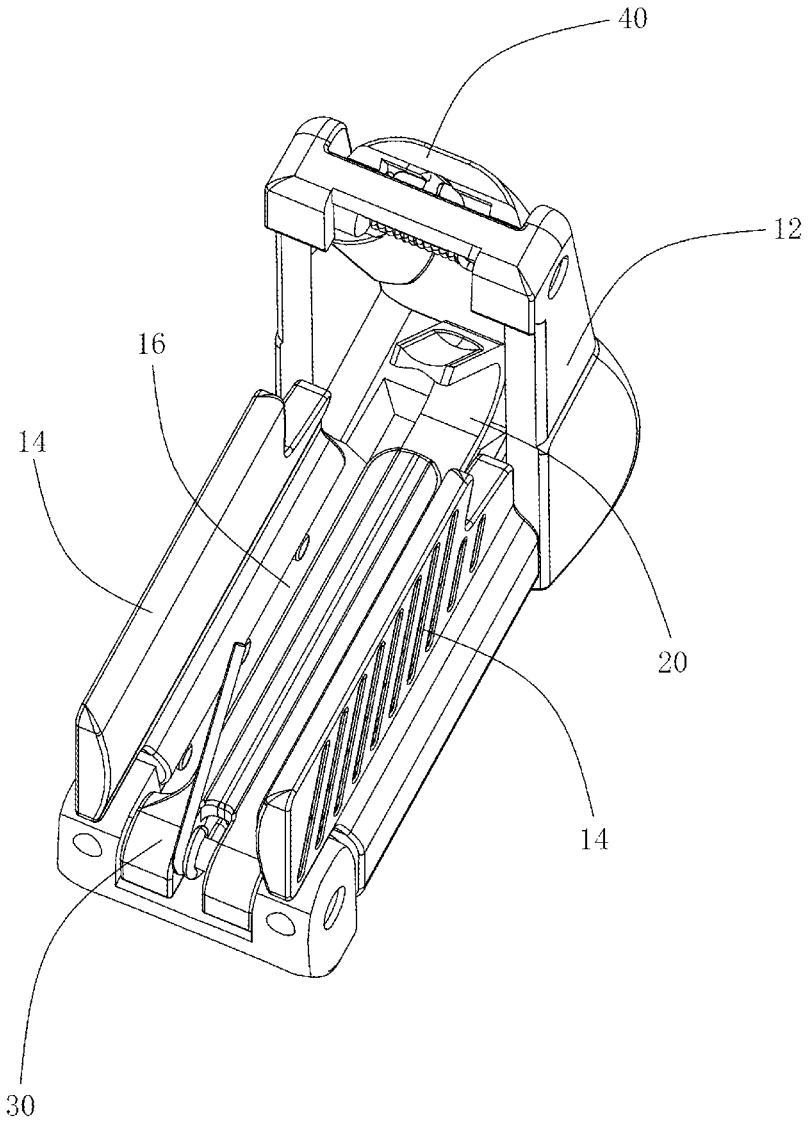
FIG. 3 is another perspective view of FIG. 2.
Figure 4:
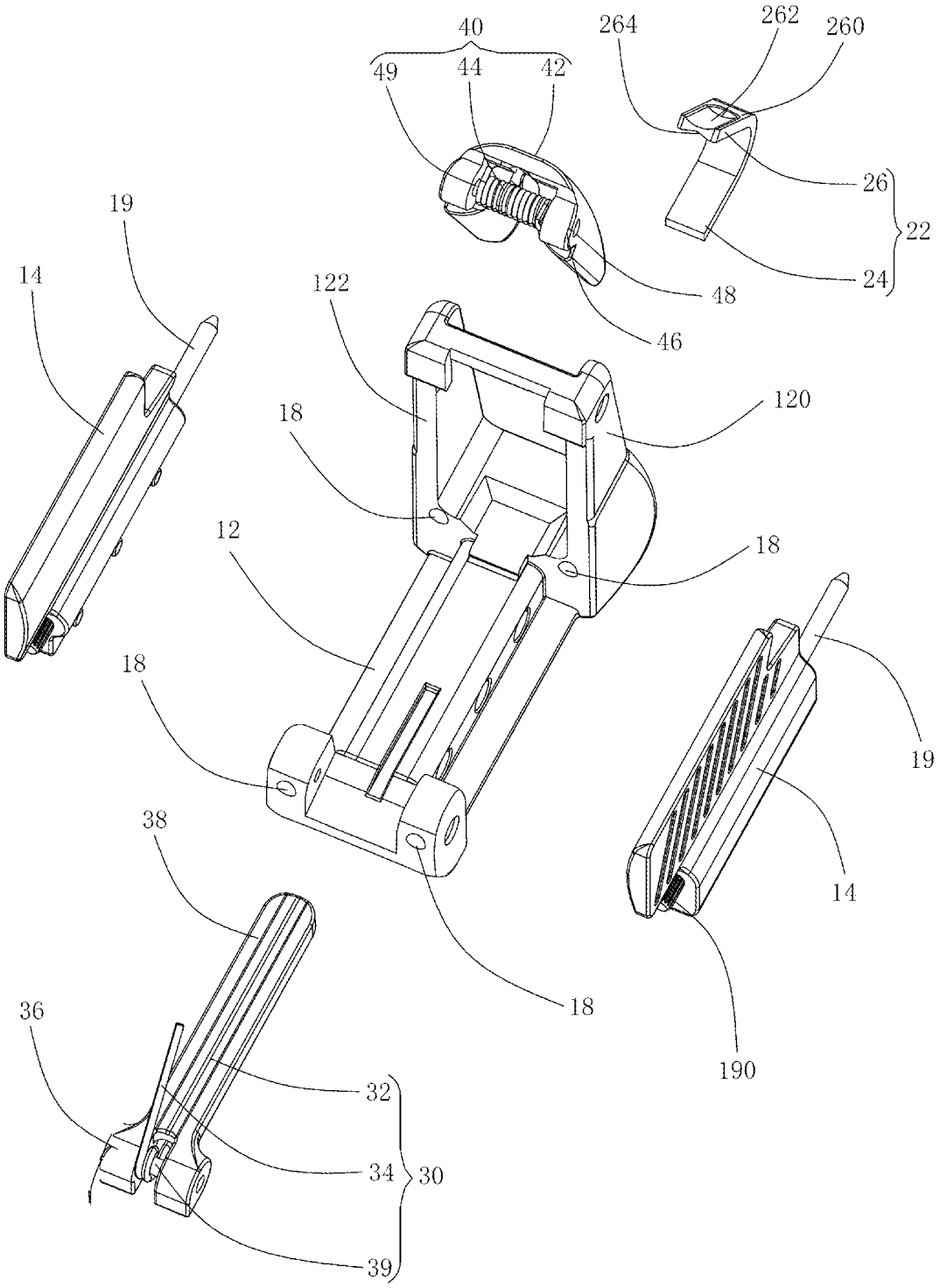
FIG. 4 is an exploded view of FIG. 3.
Figure 5:
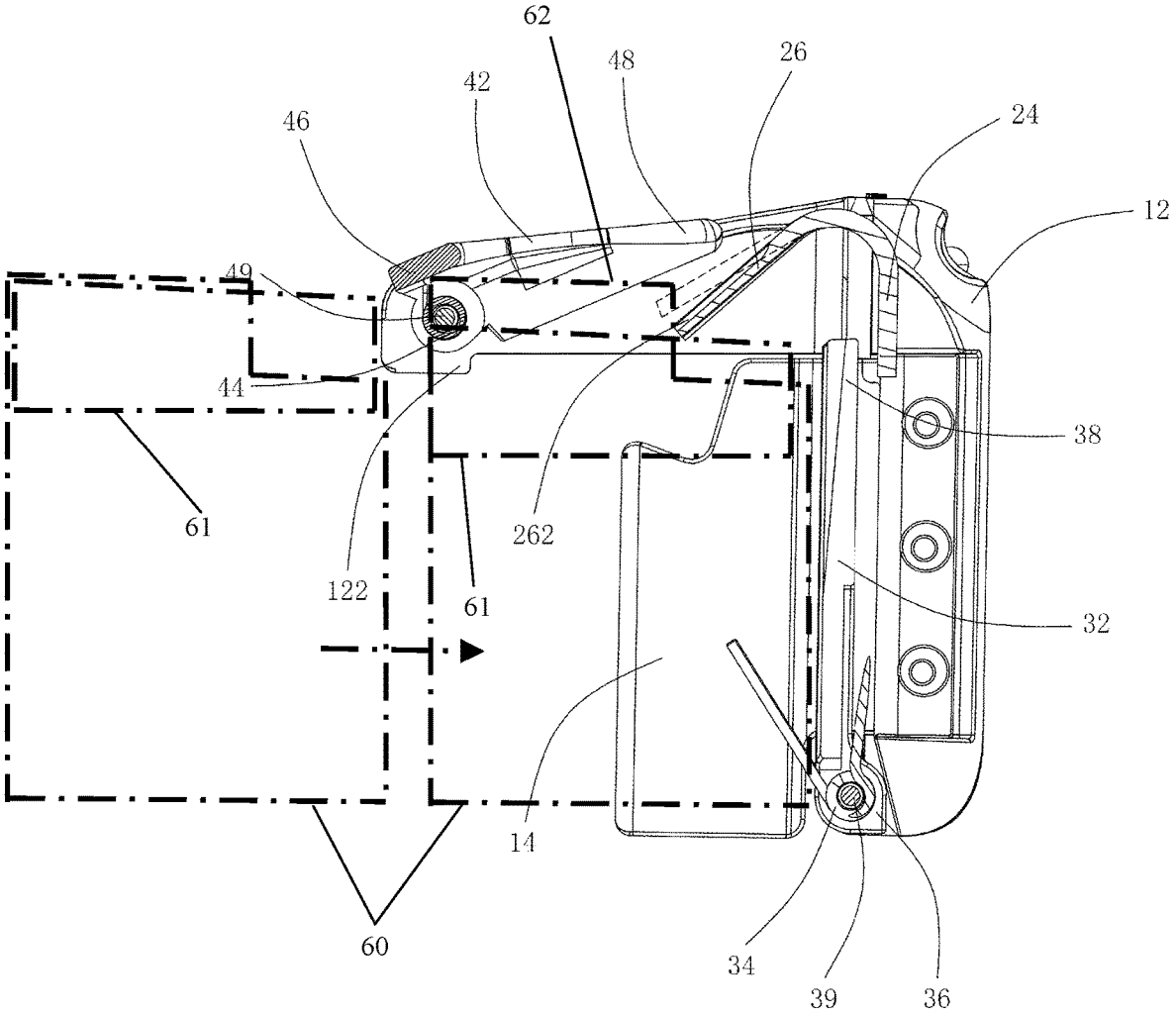
FIG. 5 is a cross-sectional view of an auxiliary bullet loader for a magazine of the present invention.

The housing 10 includes a back plate 12 and two side plates 14 respectively connected to two opposite sides of the back plate 12. The side plates 14 are respectively connected to a left side and a right side of the back plate 12 in a direction as shown in FIG. 1. A mounting space 16 of the magazine is defined between the two side plates 14. When the magazine 60 is mounted into the mounting space 16 of the housing 10, a bullet inlet 62 of the magazine faces upwards (as shown in FIG. 5), that is, faces towards the first swinging mechanism 20. In this embodiment, the side plates 14 are rotatably connected with the back plate 12, and a relative angle of the two side plates 14 may be adjusted by the rotation of the side plates 14 relative to the back plate 12, and the width of the mounting space 16 between the side plates 14 may be changed, as such, the mounting space of the present invention may be adapted to magazines with different specifications, so that the auxiliary bullet loader 100 for the magazine is excellent in universality. In this embodiment, with reference to FIG. 3 and FIG. 4, an upper end and a lower end of the back plate 12 are respectively provided with a shaft hole 18, and inner sides of the side plates 14 are sleeved on a shaft 19, and two ends of the shaft 19 extend out from the side plates 14 and are inserted into the shaft holes 18 to connect the side plates 14 with the back plate 12 rotatably.

Preferably, at least one end of the shaft 19 forms an external gear structure 190. In the illustrated embodiment, a lower end of the shaft 19 forms an external gear structure 190. Correspondingly, the shaft hole 18 in a bottom portion of the back plate 12 is of an internal gear structure, and the shaft 19 is meshed with the shaft hole 18. The side plates 14 may be positioned at an adjusted angle after an angle of the side plates 14 is adjusted. It should be understood that two ends of the shaft 19 may be provided with external gear structures 190, and correspondingly, the shaft holes 18 at the upper end and the lower end of the back plate 1 are of internal gear structures. It should be understood that in the two side plates 14, one of the side plates 14 may be fixedly connected with the back plate 12 and the other side plate 14 may be rotatably connected with the back plate 12. The width of the mounting space 16 between the two side plates 14 may be adjusted by means of the rotation of the single side plate 14, so that the mounting space 16 is adapted to the magazines with different sizes.

In addition, a shaft hole 18 may be provided in the side plate 14, and a shaft 19 may be provided on the back plate 12 correspondingly. Similarly, the side plates 14 and the back plate may be rotatably connected by means of insertion of the shaft 19 and the shaft hole 18. The mounting space is adapted to magazines with different sizes by adjusting the width between the two side plates 14. The shaft 19 and the side plates 14 or the back plate 12 may be of an integral structure, or may be connected in an inserting manner after being formed separately. In addition, a bottom plate of the housing 10 may be fixedly connected with the side plates 14, and the width of the mounting space 16 between the side plates 14 is fixed without being adjusted. At this time, although the mounting space cannot be used for magazines with different specifications, it may assist in loading of the magazines with corresponding specifications, thereby simplifying the bullet loading operation.

The first swinging mechanism 20 is configured to press the follower in the magazine to facilitate the operation of loading the bullet into the magazine. In this embodiment, the first swinging mechanism 20 includes a first pressing plate 22, and the first pressing plate 22 is preferably an elastic pressing plate, which may deform under a force.

The first pressing plate 22 includes a first connecting end 24 and a first engaging end 26 which are opposite, wherein the first connecting end 24 is connected to a top portion of the back plate 12, and the first engaging end 26 extends obliquely downwards into the mounting space 16. When the magazine 60 is mounted into the mounting space 16, the first engaging end 26 extends into the magazine and is pushed towards the back plate 12 by the magazine, as such, the first engaging end 26 of the first pressing plate 22 swings by a certain angle towards the back plate 12. As shown by dotted lines in FIG. 1 and FIG. 5, when no magazine is mounted, an included angle between the first engaging end 26 and the back plate 12 is relatively large, and a tail end of the first engaging end 26 is relatively high in a longitudinal direction. As shown by solid lines in FIG. 2 and FIG. 5, when the magazine is mounted, the first engaging end 26 is pressed to swing by a certain angle towards the back plate 12, an included angle between the first engaging end 26 and the back plate 12 is decreased, and the tail end of the first engaging end 26 moves downwards in a longitudinal direction, that is, the first engaging end 26 moves downwards for a certain distance while swinging under a force. As such, when the first engaging end 26 is pressed to swing, the follower 61 in the magazine is automatically pressed, and at this time, there is no need for pressing the bullet with hands during loading. Accordingly, the auxiliary bullet loader for the magazine is simple and convenient to operate, and high in bullet loading efficiency. The dash-dot lines shown in FIG. 5 illustrate mounting of the magazine to the auxiliary bullet loader.

Preferably, an outer wall surface 260 of the first engaging end 26 of the first pressing plate 22, that is, a wall surface away from the mounting space 16, is concavely provided with a guiding groove 262, and the guiding groove 262 penetrates downwards through the tail end of the first engaging end 26, so that the bullet may slide down the guiding groove 262 into the magazine, so that the bullet may be loaded more accurately and quickly. Preferably, an inner wall surface 264 of the first pressing plate 22, that is, a wall surface facing the mounting space 16, is of a concave arc shape, so that when the bullets have been loaded in the magazine, the first engaging end 26 presses against the bullet that has been loaded in the magazine and then presses the follower, the arc-shaped inner wall surface 264 of the first pressing plate 22 makes the first engaging end 26 better match with a cylindrical structure of the bullet. A downforce acting on the bullet is more stable and even. As such, the bullet may be loaded more quickly.

When the auxiliary bullet loader 100 for the magazine of the present invention is used, the magazine is put into the mounting space 16 of the housing 10 and the side plates 14 of the housing 10 are held to maintain the magazine on the housing 10. The first pressing plate 22 deforms due to mounting of the magazine to swing towards the back plate 12, and the tail end of the first engaging end 26 moves downwards and remains in a state of pressing the follower. Holding the magazine and pressing the follower in the magazine may be achieved by one hand. As such, a user may rapidly load the bullet without pressing the follower by the bullet when loading the bullet with the other hand. When the magazine is full of bullets, the housing 10 is released, and the first pressing plate 22 deforming by pressing towards the back plate 12 by the magazine restores and rotates in an opposite direction away from the back plate, while pushing the magazine to separate from the mounting space 16 of the housing 10, so that the magazine may be taken away directly from the mounting space 16 of the housing 10. Therefore, the entire bullet loading operation is simple, convenient, quick and efficient.

Figure 6:
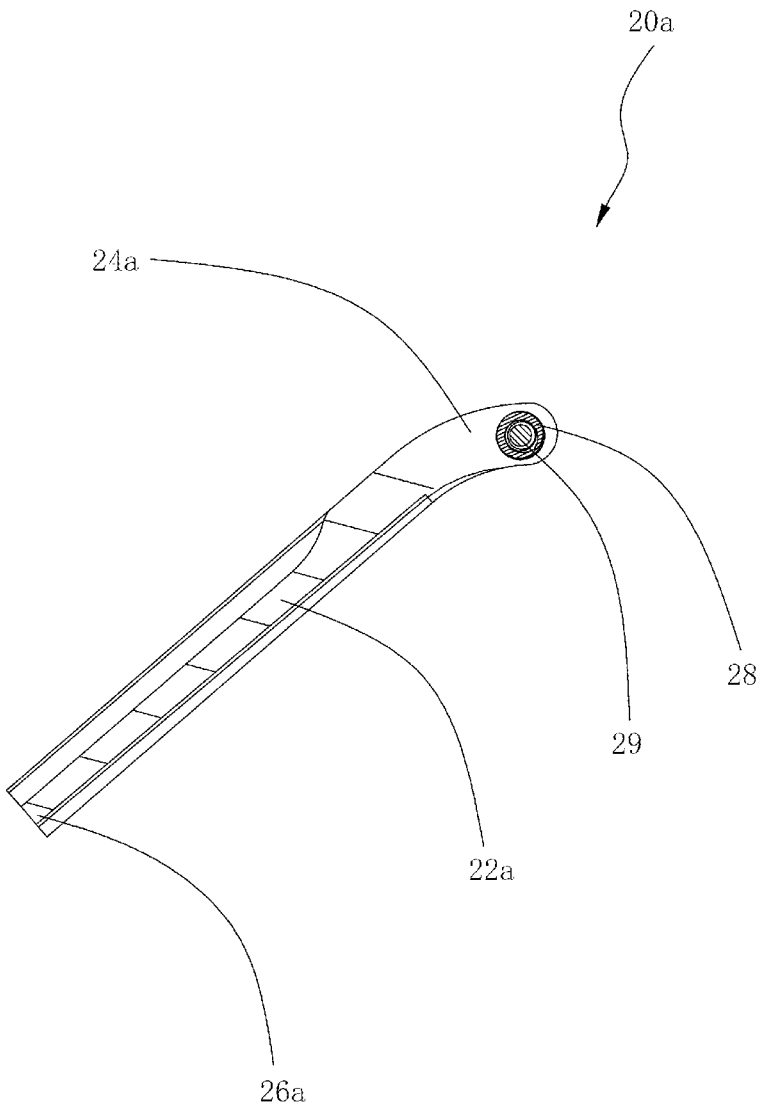
FIG. 6 is a schematic diagram showing a first swinging mechanism of an auxiliary bullet loader for a magazine according to another embodiment of the present invention.

In another embodiment of the auxiliary bullet loader for the magazine of the present invention, as shown in FIG. 6, the first pressing plate **22*a* may be of a rigid structure. At this time, the rigid first pressing plate 22*a* may be matched with the first elastic member 28 to form a first swinging mechanism 20*a*. Specifically, a first connecting end 24*a* of the first pressing plate 22*a* may be rotatably connected onto the back plate 12 of the housing 10 through a first pivot 29; the first elastic member 28 is preferably a spring or is sleeved on the first pivot 29. When the magazine is mounted into the mounting space 16 of the housing 10, the magazine pushes the first pressing plate 22*a* to rotate towards the back plate 12 around the first pivot 29 and deforms the first elastic member 28. Similarly, the first pressing plate 22*a* rotates to cause its first engaging end 26*a* to move downwards and presses the follower, so as to facilitate the loading of the bullets. After the bullets are loaded, the magazine is released, and the first elastic member 28 restores to push the first pressing plate 22*a* to rotate and reset away from the back plate 12, and further push the magazine to separate from the housing 10**.

Preferably, a second swinging mechanism 30 is connected to a bottom portion of the back plate 12 for ejecting the magazine after the bullets are loaded. In this embodiment, the second swinging mechanism 30 includes a second pressing plate 32 and a second elastic member 34. The second pressing plate 32 includes a second connecting end 36 and a second engaging end 38, wherein the second connecting end 36 is rotatably connected to the bottom portion of the back plate 12 of the housing 10 through a second pivot 39, and the second engaging end 38 extends obliquely upwards into the mounting space 16 of the housing 10. The second elastic member 34 is preferably a spring and is sleeved on the second pivot 39. When the magazine is mounted into the housing 10, the magazine pushes the second pressing plate 32 towards the back plate 12 to rotate around the second pivot 39 and deform the second elastic member 34. After the bullets are loaded, the magazine is released, and the second elastic member 34 restores to push the second pressing plate 32 to move away from the back plate 12 to facilitate the magazine to separate from the housing 10.

Preferably, a first arm portion 120 and a second arm portion 122 protrude forwards on two sides of the back plate 12, and a third swinging mechanism 40 is provided between the first arm portion 120 and the second arm portion 122 for ejecting the magazine after the bullets are loaded. In this embodiment, the third swinging mechanism 40 includes a third pressing plate 42 and a third elastic member 44. The third pressing plate 42 includes a third connecting end 46 and a third engaging end 48, wherein the third connecting end 46 is rotatably connected between the first arm portion 120 and the second arm portion 122 through a third pivot 49, and the third engaging end 48 extends obliquely downwards into the mounting space 16 of the housing 10. The third elastic member 44 is preferably a spring and is sleeved on the third pivot 49. The third engaging end 48 is arranged opposite to the first engaging end 26, the first engaging end 26 inclines forwards and downwards, and the third engaging end 48 inclines backwards and downwards. When the magazine is mounted into the housing 10, the magazine pushes the third pressing plate 42 to rotate upwards around the third pivot 49 and deforms the third elastic member 44. After the bullets are loaded, the magazine is released, and the third elastic member 44 restores to push the third pressing plate 42 to rotate downwards, so as to facilitate the magazine to separate from the housing 10.

By providing the second swinging mechanism 30 and the third swinging mechanism 40, action forces for pushing the magazine to eject outwards are respectively formed on the upper end and the lower end of the magazine, thereby ensuring that the magazine may be automatically ejected smoothly after being filled with the bullets and the magazine is conveniently taken away. It should be understood that the second swinging mechanism 30 may be composed of a second elastic pressing plate, and swings by means of an elastic deformation of the second pressing plate itself, so that the second elastic member 34 is omitted. Similarly, the third swinging mechanism 40 further includes a third elastic pressing plate, and swings by means of an elastic deformation of the third pressing plate itself, so that the third elastic member 44 is omitted. It should be understood that the second swinging mechanism 30 and the third swinging mechanism 40 are used to assist the magazine to separate from the housing 10, but when an elastic restoring force of the first swinging mechanism 20 is large enough, the magazine may be automatically released independently. At this time, the second swinging mechanism 30 and the third swinging mechanism 40 may be omitted. As such, the structure may be further simplified.

It should be noted that the present invention is not limited to the above-mentioned embodiments. According to the inventive spirit of the present invention, those skilled in the art may make other variations. These variations made according to the inventive spirit of the present invention should all be included in the scope of protection of the present invention.

What is claimed is:

1. An auxiliary bullet loader for a magazine, comprising a housing, wherein the housing is provided with a mounting space for accommodating a magazine, a first swinging mechanism is connected to a top portion of the housing, the first swinging mechanism comprises a first pressing plate, the first pressing plate comprises a first engaging end, the first engaging end extends obliquely downwards into the mounting space; when the magazine is loaded into the mounting space, a bullet inlet of the magazine faces upwards, and the first engaging end is inserted into the magazine and swings relative to the housing under an action of the magazine, thereby pressing follower within the magazine; the housing comprises a back plate and side plates respectively connected to a left side and a right side of the back plate, the mounting space is formed between the side plates, and the first swinging mechanism is connected to a top portion of the back plate; one of the side plates and the back plates is provided with a shaft hole and the other one is provided with a shaft, and the shaft is inserted into the shaft hole to connect the side plates with the back plate rotatably.

2. The auxiliary bullet loader for the magazine according to claim 1, wherein the first pressing plate is an elastic pressing plate, and the first engaging end deforms under the action of the magazine to swing relative to the housing.

3. The auxiliary bullet loader for the magazine according to claim 1, wherein the first swinging mechanism further comprises a first elastic member and a first pivot, wherein the first pressing plate is pivotally connected onto the housing through the first pivot, and the first elastic member is sleeved on the first pivot, the first engaging end swings around the first pivot under the action of the magazine to deform the first elastic member.

4. The auxiliary bullet loader for the magazine according to claim 1, wherein a guiding groove is provided in an outer wall surface, which is away from the mounting space, of the first engaging end.

5. The auxiliary bullet loader for the magazine according to claim 1, wherein an inner wall surface, which faces the mounting space, of the first engaging end is an arc-shaped surface.

6. The auxiliary bullet loader for the magazine according to claim 1, wherein the auxiliary bullet loader for the magazine further comprises a second swinging mechanism connected to a bottom portion of the housing, wherein the second swinging mechanism comprises a second pressing plate, the second pressing plate comprises a second engaging end, the second engaging end extends obliquely upwards into the mounting space, and the second engaging end swings relative to the housing under the action of the magazine when the magazine is mounted into the mounting space.

7. The auxiliary bullet loader for the magazine according to claim 6, wherein the second pressing plate is an elastic pressing plate, and the second engaging end deforms under the action of the magazine to swing relative to the housing.

8. The auxiliary bullet loader for the magazine according to claim 6, wherein the second swinging mechanism further comprises a second elastic member and a second pivot, wherein the second pressing plate is connected onto the housing through the second pivot, the second elastic member is sleeved on the second pivot, and the second engaging end swings around the second pivot under the action of the magazine and deforms the second elastic member.

9. The auxiliary bullet loader for the magazine according to claim 1, further comprising a third swinging mechanism connected to the top portion of the housing, wherein the third swinging mechanism and the first swinging mechanism are respectively positioned on a front side and a rear side of the top portion of the housing.

10. The auxiliary bullet loader for the magazine according to claim 9, wherein the third swinging mechanism comprises a third pressing plate, wherein the third pressing plate comprises a third engaging end, the third engaging end extends into the mounting space, the third engaging end inclines downwards and backwards, and the first engaging end inclines downwards and forwards.

11. The auxiliary bullet loader for the magazine according to claim 10, wherein the third pressing plate is an elastic pressing plate, and the third engaging end deforms under the action of the magazine to swing relative to the housing.

12. The auxiliary bullet loader for the magazine according to claim 10, wherein the third swinging mechanism further comprises a third elastic member and a third pivot, wherein the third pressing plate is connected onto the housing through the third pivot, and the third elastic member is sleeved on the third pivot, and the third engaging end swings around the third pivot under the action of the magazine and deforms the third elastic member.

13. The auxiliary bullet loader for the magazine according to claim 1, wherein a tail end of the shaft is of an external gear structure, the shaft hole is of an internal gear structure, and the tail end of the shaft is inserted into the shaft hole and meshed with the shaft hole.

14. An auxiliary bullet loader for a magazine, comprising a housing, wherein the housing comprises a back plate and side plates connected to two opposite sides of the back plate, and a mounting space is formed between the side plates for accommodating a magazine, a first swinging mechanism is connected to a top portion of the back plate; the first swinging mechanism comprises a first pressing plate, wherein the first pressing plate comprises a first connecting end and a first engaging end which are opposite, the first connecting end is connected with the housing, the first engaging end extends obliquely downwards into the mounting space, the magazine is mounted within the mounting space between the two side plates towards the back plate, the first engaging end is inserted into the magazine and swings towards the back plate under an action of the magazine to press a follower in the magazine; an arm portion protrudes forwards from the top portion of the back plate, a third swinging mechanism is connected onto the arm portion, the third swinging mechanism comprises a third pressing plate, a third elastic member and a third pivot, the third pressing plate comprises a third connecting end and a third engaging end which are opposite, the third connecting end is connected onto the arm portion through the third pivot, the third elastic member is sleeved on the third pivot, the third engaging end extends obliquely downwards into the mounting space, and when the magazine is mounted into the mounting space, the third engaging end swings upwards around the third pivot under the action of the magazine and deforms the third elastic member.

15. The auxiliary bullet loader for the magazine according to claim 14, wherein the first swinging mechanism further comprises a first elastic member and a first pivot, wherein the first connecting end is connected onto the housing through the first pivot, and the first elastic member is sleeved on the first pivot, and the first engaging end swings around the first pivot under the action of the magazine and deforms the first elastic member.

16. The auxiliary bullet loader for the magazine according to claim 14, wherein further comprising a second swinging mechanism connected to a bottom portion of the back plate, wherein the second swinging mechanism comprises a second pressing plate, a second elastic member and a second pivot, the second pressing plate comprises a second connecting end and a second engaging end which are opposite, the second connecting end is connected onto the back plate through the second pivot, the second elastic member is sleeved on the second pivot, the second engaging end extends obliquely upwards into the mounting space, and when the magazine is mounted in the mounting space, the second engaging end swings towards the back plate around the second pivot under the action of the magazine and deforms the second elastic member.

17. The auxiliary bullet loader for the magazine according to claim 14, wherein one of the side plates and the back plate is provided with a shaft hole and the other one is provided with a shaft, a tail end of the shaft is of an external gear structure, the shaft hole is of an internal gear structure, and the tail end of the shaft is inserted into the shaft hole and meshed with the shaft hole.

* * * * *